United States Patent [19]

Tone

[11] Patent Number: 4,766,022

[45] Date of Patent: Aug. 23, 1988

[54] RECTANGULAR TILE-LIKE CARPET WITH LOOPED TILE ON BOTH SURFACES

[75] Inventor: Yasuyoshi Tone, Yokohama, Japan

[73] Assignee: Saami Co., Ltd., Tokyo, Japan

[21] Appl. No.: 921,500

[22] Filed: Oct. 22, 1986

Related U.S. Application Data

[62] Division of Ser. No. 732,034, May 8, 1985, Pat. No. 4,649,069.

[30] Foreign Application Priority Data

May 12, 1984 [JP] Japan ..... 59-69502[U]
May 12, 1984 [JP] Japan ..... 59-69503[U]

[51] Int. Cl.[4] ..... B32B 3/02
[52] U.S. Cl. ..... 428/95; 428/62
[58] Field of Search ..... 428/62, 95

[56] References Cited

U.S. PATENT DOCUMENTS

| | | | |
|---|---|---|---|
| 2,073,894 | 3/1937 | Wood | 428/95 |
| 2,641,045 | 6/1953 | Meister et al. | 428/95 |
| 3,322,606 | 5/1967 | Koller | 428/95 |
| 3,533,893 | 10/1970 | Hartstein | 428/95 |
| 3,919,444 | 11/1975 | Shayman | 428/95 |
| 4,415,618 | 11/1983 | McClung | 428/95 |
| 4,576,848 | 3/1986 | Dillon et al. | 428/95 |

*Primary Examiner*—Marion C. McCamish
*Attorney, Agent, or Firm*—Pollock, VandeSande & Priddy

[57] ABSTRACT

A rectangular tile-like carpet the body of which has front and back pile layers is disclosed. Both front and back sides of the carpet can be used, so that the frequency of cleaning the carpet can be reduced to save expenditure and labor. Also, the two pile layers increase the cushioning property of the carpet. Further, the front and back pile layers may have different colors to permit different colors to be enjoyed by merely inverting the carpet.

3 Claims, 4 Drawing Sheets

RECTANGULAR TILE-LIKE CARPET WITH LOOPED TILE ON BOTH SURFACES

This is a division of application Ser. No. 732,034 filed May 8, 1985, now U.S. Pat. No. 4,649,069.

BACKGROUND OF THE INVENTION

1. Field of the Invention

This invention relates to a rectangular tile-like carpet, which has both front and back pile layers that constitute a rectangular tile-like carpet body so that both sides can be used.

2. Prior Art

In the prior art carpet, pile is set in the front side of a rectangular tile-like carpet body backed by a backing material, e.g., rubber latex. With this carpet, only the front side with the pile can be used. Therefore, it has to be cleaned frequently for the single side, i.e., front side, is soon contaminated. The cleaning demands considerable expenditure and labor. In addition, the carpet is incapable of readily changing colors.

Further, in use a plurality of such carpets are laid on a floor such that they are closely adjacent to one another. At this time, the individual carpets are independently secured to the floor using separate securing means, e.g., an adhesive or adhesive tape, thereby maintaining their positional stability relative to one another.

In this case, the operation of securing the carpets to the floor with the securing means such as adhesive or adhesive tape is very cumbersome and time consuming. In addition, it requires considerable skill to secure the carpets to the floor without forming a gap between adjacent ones. Further, a considerable amount of material has to be used as the securing means. Therefore, it requires a considerable expenditure to lay carpets.

SUMMARY OF THE INVENTION

A primary object of the invention is to provide a rectangular tile-like carpet body consisting of front and back pile layers. With this structure, the back side can be used when the front side is contaminated. This means that the carpet may be cleaned when both sides are contaminated. Thus, it is possible to reduce the frequency of its cleaning and hence the expenditure and labor thereof. In addition, the two pile layers of the carpet can improve the cushioning property, and the cushioning material can be dispensed with.

A second object of the invention is to provide a carpet in which the front and back pile layers of the carpet body have different colors. With this carpet, different colors can be enjoyed by merely inverting it.

A third object of the invention is to provide a carpet in which the front and back pile layers of the carpet body have mutually crossing pile setting directions. With this structure, the rigidity in the direction of its plane is increased, thus eliminating the possibility of curving of the surface of the carpet body or curling of the edges thereof after the carpet has been laid.

A fourth object of the invention is to provide a carpet in which two sides of the carpet body forming one corner thereof each have at least one extension extending in the plane of and substantially flush with one surface of the body and having a thickness substantially one-half the thickness of the body, while the other two sides of the body forming the corner diagonally opposite the first-mentioned corner each have at least one depression complementary to and having the same size as the extension. With this structure, a plurality of carpets can be laid on a floor such that the extension and depression of adjacent carpets overlap, with one of them urged from above by the other. Thus, it is possible to reliably eliminate the curl-up of the edges of the carpet and stably hold the individual carpets in regular relative positions without use of any separate securing means. Further, even if a slight gap is formed between adjacent carpets, the floor will not be exposed, so that the appearance is not substantially degraded. Further, the carpets can be laid with high efficiency even by a person who does not have any particular skill in this respect.

A fifth object of the invention is to provide a carpet in which two sides of the carpet body forming one corner thereof each have an extension extending in the plane of and substantially flush with one surface of the body and a depression formed in the surface, the extension and depression having a thickness substantially one-half the thickness of the body, while the other two sides of the body forming the corner diagonally opposite the first-mentioned corner each have a depression complementary to and having the same size as the extension and a extension complementary to and having the same size as the first-mentioned depression. With this structure, the extensions and depressions of adjacent carpet bodies laid on a floor overlap one another so they can be urged from above by one another. Thus it is possible to more reliably eliminate the curl-up of the edges of the carpet and more stably hold the individual carpets in regular relative positions without use of any separate securing means.

The above objects, features and advantages of the invention will become more apparent from the description of the preferred embodiments of the invention, when the same is read with reference to the accompanying drawings.

DESCRIPTION OF THE PREFERRED EMBODIMENTS

Figure 1:
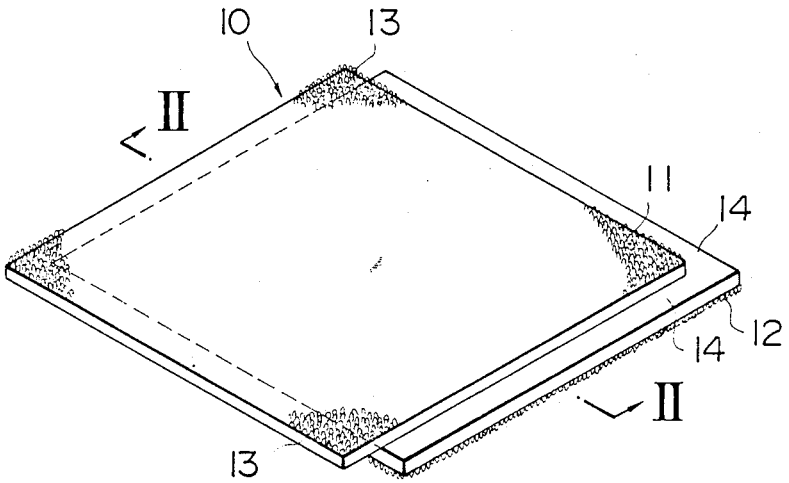
FIG. 1 is a perspective view showing a first embodiment of the carpet according to the invention.
Figure 2:
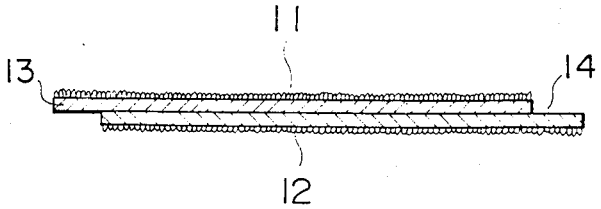
FIG. 2 is a sectional view taken along line II—II and in the direction of arrows in FIG. 1.
Figure 3:
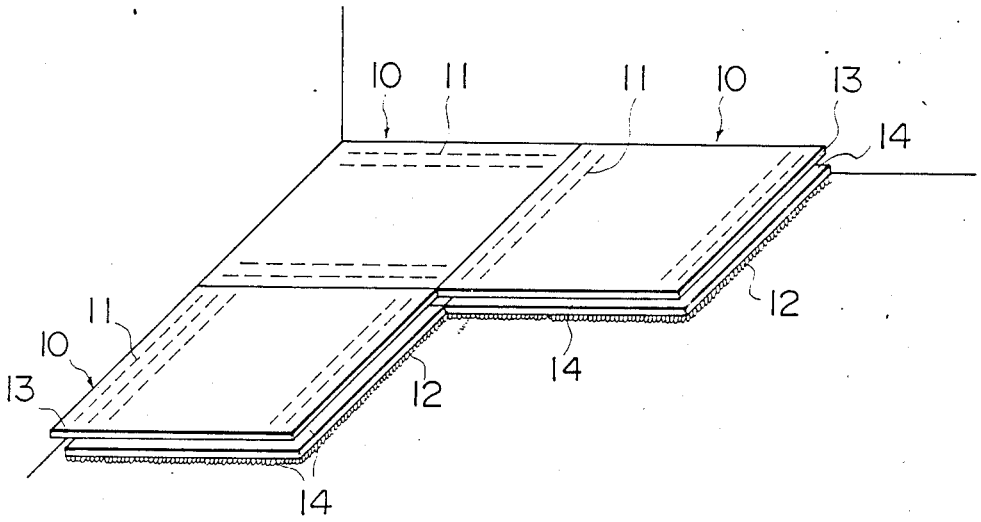
FIG. 3 is a perspective view showing a plurality of carpets shown in FIG. 1 laid together.

FIGS. 1 to 3 show a first embodiment of the invention. Referring to the Figures, reference numeral 10 designates a square tile-like carpet body about 30 cm in the length of one side and about 1 cm in thickness. The body 10 has front and back pile layers 11 and 12. The pile layers 11 and 12 have different colors. Also, these pile layers 11 and 12 have mutually crossing pile setting directions (as shown by dashed lines). Further, two sides of the carpet body 10 forming one corner thereof each have an extension 13 extending in the plane of and substantially flush with one surface of the body and having a thickness substantially one-half of the thickness of the body, while the other two sides forming the corner diagonally opposite the corner noted above each have a depression 14 complementary to and having the same size as the extension 13.

The carpet body 10 having the extension 13 and depression 14 as shown can be readily fabricated by forming an eventual carpet body having a predetermined size and then forming the extension and depression by removing corresponding portions of the body or by separately forming the front half body and the back half body having pile layers 11 and 12 and bonding together these half bodies such that they are shifted slightly diagonally with respect to each other.

FIG. 3 shows a plurality of square tile-like carpets having the above structure which is laid on a floor. As is shown, the extension 13 and depression 14 of adjacent carpet bodies overlap each other so that one of the carpet bodies is urged from above by the other. Thus, it is possible to reliably eliminate the curl-up of the edges of the carpet body 10 and stably hold the individual carpet bodies 10 in regular relative positions without use of any separate securing means. In addition, since the extension 13 and depression 14 of adjacent carpet bodies 10 overlap, even if a slight gap is formed between the adjacent carpet bodies 10, the floor will not be exposed, so that the appearance is not substantially degraded. Further, the carpet bodies 10 can be laid with high efficiency even by a person who does not have any particular skill in this respect. Still further, since both the front and back sides of the carpet body 10 can be used as carpet, it is possible to reduce the frequency of its cleaning and hence the expenditure and labor thereof. Furthermore, the two pile layers of the carpet body can improve the cushioning property. Moreover, since the front and back pile layers have different colors, the carpet permits different colors to be enjoyed by merely inverting it.

Further, where a plurality of carpets is laid such that the pile layers 11 of adjacent carpet bodies 10 have mutually crossing pile setting directions, the collapse of an outermost portion of the pile layer 11 in the direction crossing the pile setting direction of the pile layer 11 of an adjacent carpet body 10 can be reliably prevented by the pile layer 11 of the adjacent carpet body 10.

Where the carpet bodies 10 are laid in the manner as described above, the depression 14 of a carpet body 10 laid adjacent to a wall of the room is exposed. The exposed depression may be filled with a strip-like piece as the same material of the carpet body 10.

Figure 4:
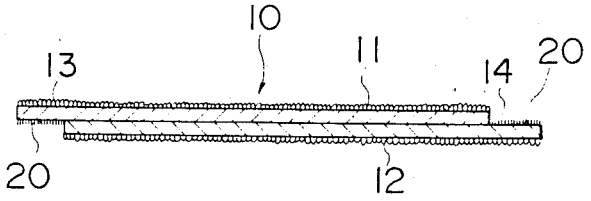
FIG. 4 is a view similar to FIG. 2 but showing a modification of the carpet shown in FIG. 1.

Further, if the contact surfaces of the extension 13 and depression 14 of the carpet body 10 shown in FIG. 1 are provided with securing means, e.g., surface fasteners 20 as shown in FIG. 4, the individual carpet bodies 10 laid on a floor may be more stably held in regular relative positions.

The other functions and effectiveness are similar to the previous embodiment.

Of course, it is possible to use separate securing means when laying the carpet body 10 according to the invention.

Figure 5:
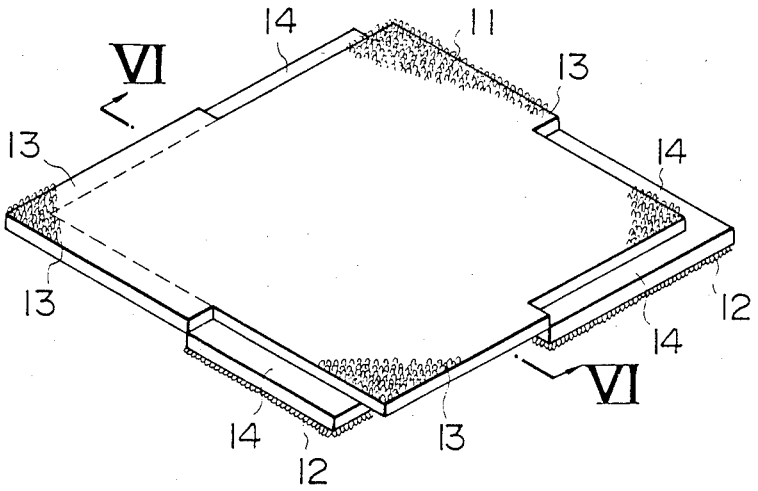
FIG. 5 is a perspective view showing a second embodiment of the carpet according to the invention.
Figure 6:
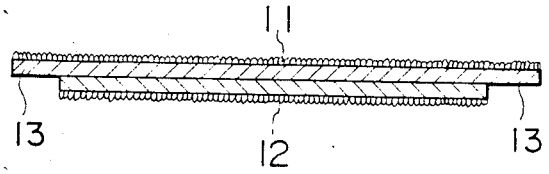
FIG. 6 is a sectional view taken along line VI—VI and in the direction of arrows in FIG. 5.
Figure 7:
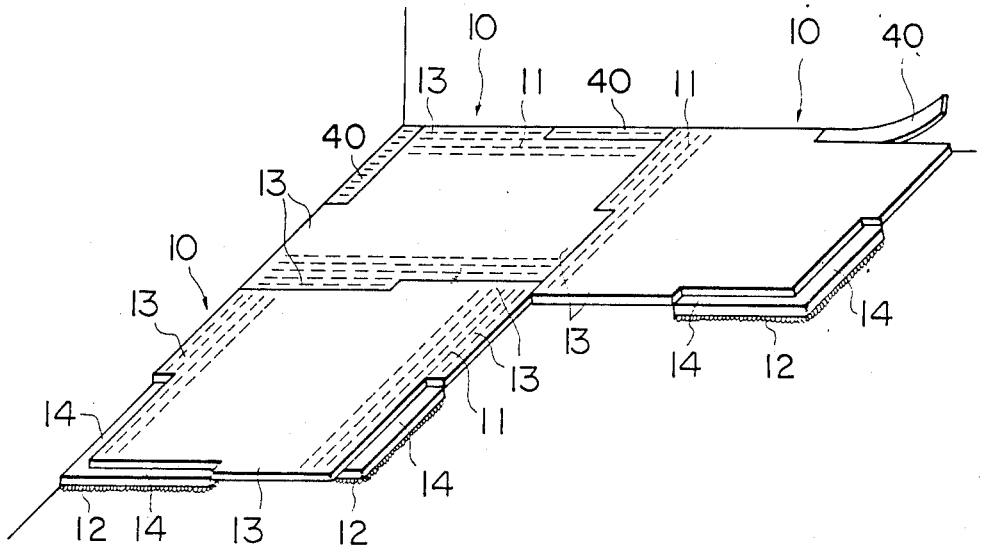
FIG. 7 is a view showing a plurality of carpets shown in FIG. 5 laid together.

FIGS. 5 to 7 show a second embodiment of the invention. In this embodiment, two sides of carpet body 10 forming one corner thereof each have at least one extension 13 extending in the plane of and substantially flush with one surface of the body and one depression 14 formed in the same surface, the extension 13 and depression 14 having a thickness substantially one-half the thickness of the body, while the other two sides of the body forming the corner diagonally opposite to the first-mentioned corner each have at least one depression 14 complementary to and having the same size as the extension 13 noted above and one extension 13 complementary to and having the same size as the first-mentioned depression 14.

FIG. 7 shows a plurality of square tile-like carpets having the structure shown in FIG. 5 which is laid on a floor. In this case, the extensions 13 and depressions 14 of adjacent carpet bodies 10 overlap one another, so that these carpet bodies are urged from above by each other. It is thus possible to hold the individual carpet bodies 10 more stably in regular relative positions.

Figure 8:
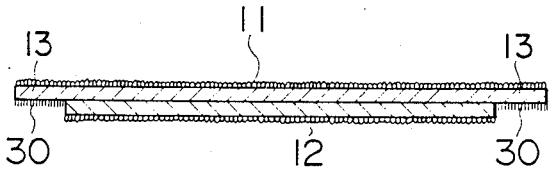
FIG. 8 is a view similar to FIG. 6 but showing a modification of the carpet shown in FIG. 5.

Further, if the contact surfaces of the extensions 13 and depressions 14 of the carpet body 10 shown in FIG. 8 are provided with securing means, e.g., surface fasteners 30, the individual carpet bodies 10 laid on a floor may be still more stably held in regular relative positions.

Again, an exposed depression 14 of a carpet body 10 laid adjacent to a wall of a room may be filled, if necessary, with a carpet piece 40 of the same material as the carpet body 10.

What is claimed:

1. A carpet comprising a rectangular tile-like carpet body consisting of front and back loop-pile layers.

2. The carpet according to claim 1, wherein said front and back pile layers of said carpet body have different colors.

3. The carpet according to claim 1, wherein said front and back pile layers of said carpet body have mutually crossing pile setting directions.

* * * * *

UNITED STATES PATENT AND TRADEMARK OFFICE

CERTIFICATE OF CORRECTION

PATENT NO. : 4,766,022

DATED : August 23, 1988

INVENTOR(S) : Yasuyoshi Tone

It is certified that error appears in the above-identified patent and that said Letters Patent is hereby corrected as shown below:

Correct the title of the invention to read --RECTANGULAR TILE-LIKE CARPET WITH LOOPED PILE ON BOTH SURFACES--.

Column 2, line 24, change "a" to --an--.

Column 3, line 52, change "as the same material of the" to --of the same material as the--.

Signed and Sealed this

Twenty-eighth Day of February, 1989

*Attest:*

DONALD J. QUIGG

*Attesting Officer*

*Commissioner of Patents and Trademarks*